United States Patent [19]

Tizzoni

[11] Patent Number: 4,974,366

[45] Date of Patent: Dec. 4, 1990

[54] THERMALLY INSULATED ALUMINUM DOOR FRAME

[76] Inventor: Salvatore Tizzoni, 8465 Fernand Forest, Monteal, Quebec, Canada, H1E 4K2

[21] Appl. No.: 454,606

[22] Filed: Dec. 21, 1989

[51] Int. Cl.[5] ..... E06B 1/12

[52] U.S. Cl. ..... 49/504; 49/399; 49/400; 49/478; 49/DIG. 1

[58] Field of Search ..... 49/478, 504, DIG. 1, 49/398–401, 485, 381

[56] References Cited

U.S. PATENT DOCUMENTS

| | | | |
|---|---|---|---|
| 2,910,154 | 10/1959 | Hammitt et al. | 49/399 |
| 2,978,755 | 4/1961 | Walker | 49/401 |
| 3,037,589 | 6/1962 | Cole . | |
| 3,141,205 | 7/1964 | Russell . | |
| 3,171,157 | 3/1965 | Loughlin | 49/400 X |
| 3,287,856 | 11/1966 | Passovoy | 49/381 X |
| 3,969,846 | 7/1976 | Scott | 49/504 |
| 4,175,357 | 11/1979 | Goldhaber | 49/401 X |
| 4,281,481 | 8/1981 | Wendt | 49/504 |
| 4,307,543 | 12/1981 | Schulthess | 49/504 X |
| 4,344,254 | 8/1982 | Varlonga . | |
| 4,573,287 | 3/1986 | Hagemeyer et al. | 49/381 |
| 4,605,725 | 8/1986 | Christman | 49/DIG. 1 X |
| 4,607,457 | 8/1986 | Shewchuk | 49/400 |
| 4,748,771 | 6/1988 | Lehnert et al. | 49/399 |
| 4,841,700 | 6/1989 | Matthews | 49/DIG. 1 X |

*Primary Examiner*—Philip C. Kannan
*Assistant Examiner*—Jerry Redman
*Attorney, Agent, or Firm*—Diller, Ramik & Wight

[57] ABSTRACT

A frame construction for a door opening comprises an elongated aluminum extrusion adapted to be secured to a wall defining the door opening. The aluminum extrusion includes first and second elongated spaced apart members each having an L-shaped profile and having first and second longitudinal free edges which form a channel configuration at least partly open-ended towards the door opening between the first free edges. The sides of the channel configuration are parallel to the plane of the door opening whereas the bottom walls thereof extend towards each other without joining one another. An insulating vinyl strip extends between the first free edges in order to close the open end of the channel configuration. The cavity thus defined is filled with an insulating structural filler material generally made of a rigid polyurethane foam. A thermal barrier is therefore provided in the frame construction as the L-shaped members of the aluminum extrusion are separated by the insulating strip and by the insulating filler material with the latter providing rigidity to the aluminum extrusion. The method for producing this frame construction initially has the bottom walls of the channel configuration integrally joining one another, thereby forming a U-shaped channel which is first closed by the insulating strip and then injected with the structural filler material. An elongated strip is then removed from the bottom wall of the U-shaped channel with the integrity of the frame construction being maintained by the rigidified insulating structural filler material.

8 Claims, 2 Drawing Sheets

THERMALLY INSULATED ALUMINUM DOOR FRAME

BACKGROUND OF THE INVENTION

1. Field of the Invention

The present invention relates to door frames and, more particularly to a thermally insulated aluminum door frame.

2. Description of the Prior Art

There already exists some frame constructions for doors which are designed to avoid heat transfer between the inner and outer wall surfaces at the door opening. U.S. Pat. No. 3,141,205, issued on July 21, 1964 to Russell, discloses a jamb construction which can be installed for use with many different types of panels or walls. This jamb construction which is made from a plastic resilient material could provide such a thermal barrier by using, more specifically, an insulating resilient material. However, it is not shown how the door is hinged to the jamb construction while maintaining the thermal barrier.

In U.S. Pat. No. 3,037,589, issued on June 5, 1962 to Cole, the insulated frame comprises two metal ogee sections, one on each side of the wall, each including three flanges, one of which extends within the door opening. An insulated resilient connector strip is provided to join the two ogee sections within the door opening. The connector strip further provides bearings against which the door closes for sealing and shock absorbing purposes. Although this construction provides a thermal break, again, it is not shown how the door is hinged to the frame construction.

U.S. Pat. No. 4,344,254, issued on Aug. 17, 1982 to Varlonga, discloses a door frame provided with an uninterrupted heat insulating barrier disposed between two distinct metal sub-frames forming the fixed framework mounted to the wall. The construction disclosed in this Patent is rather complicated. As in the previous Patent, a conventional hinge could not be solidly secured to the frame construction as it would have to be mounted to tubular sections of the framework. For instance, if screws are used to fasten a leaf hinge to these patented jambs, these screws would then be engaged through a thin metal sheet of the jamb, with most of the threads thereof being thus useless as hanging in cavities of the tubular sections.

SUMMARY OF THE INVENTION

It is therefore an aim of the present invention to provide a thermally insulated door frame which is of simple construction and easily mounted to the edges of a wall defining a door opening.

It is also an aim of the present invention to provide a thermally insulated door frame which comes in a one-piece construction prior to its mounting to the wall defining the door opening.

It is still a further aim of the present invention to provide a thermally insulated door jamb to which a conventional hinge assembly, such as a leaf hinge, can be solidly mounted.

A construction in accordance with the present invention comprises a frame construction for a wall opening which includes a rigid metallic member adapted to be secured along a length of a wall defining the wall opening. The metallic member comprises first and second elongated spaced apart members each having first and second longitudinal free edges forming a channel configuration at least partly open-ended towards the wall opening between said first free edges. An insulating strip means is provided to extend between the first free edges of the spaced apart members in order to close the open end of the channel configuration and to define an elongated cavity therein. An insulating structural filler material is provided in the elongated cavity, whereby a thermal barrier is provided in the frame construction between the first and second spaced apart members which are separated by the insulating strip means and the structural filler material. The frame construction is thus adapted to receive a leaf hinge thereon while maintaining the thermal barrier. The leaf hinge is positioned to at least partly overlie the insulating strip means and is fastened to the frame construction by way of screws passing through the insulating strip means and threadingly engaging the structural filler material, the hinge being spaced from at least one of the first and second spaced apart members of the metallic member in order to maintain the thermal barrier.

In a more specific construction in accordance with the present invention, the first and second spaced apart members of the rigid metallic member are symmetric generally L-shaped members each having first and second sections. The first sections of the first and second L-shaped members are substantially parallel to a plane of the wall opening whereas the second sections thereof extend towards each other at right angles from their respective first sections in order to define bottom walls of the channel configuration. The first and second free edges of the spaced apart members correspond respectively to the free edges of the first and second sections of the L-shaped members, the second free edges being spaced from one another.

In a still more specific construction in accordance with the present invention, the metallic member is an aluminum extrusion. The insulating filler material is an injected rigid polyurethane foam, such as Isolok TM.

A method for manufacturing a frame construction in accordance with the present invention and intended for a wall opening comprises producing an elongated rigid metallic member having an elongated back portion adapted to contact a wall defining the wall opening and further including a U-shaped, elongated channel means defined therein; the channel means has a pair of free longitudinal edges which are spaced from one another, whereby the channel means is open-ended opposite the back portion and towards the wall opening. The free edges of the U-shaped channel means are then joined by an elongated insulating strip means which closes the channel means in order to define a cavity therein. An insulating structural filler material is then injected in the cavity. The structural filler material is then allowed to set in the cavity. An elongated strip is then cut along the entire length of part of a bottom wall of the channel means and then removed therefrom; the channel means thus includes two spaced apart members joined and maintained together by the insulating strip means and the structural filler material, whereby a thermal barrier is provided to the frame construction.

BRIEF DESCRIPTION OF THE DRAWINGS

Having thus generally described the nature of the invention, reference will now be made to the accompanying drawings, showing by way of illustration only a preferred embodiment thereof, and in which.

DESCRIPTION OF THE PREFERRED EMBODIMENTS

Figure 1:
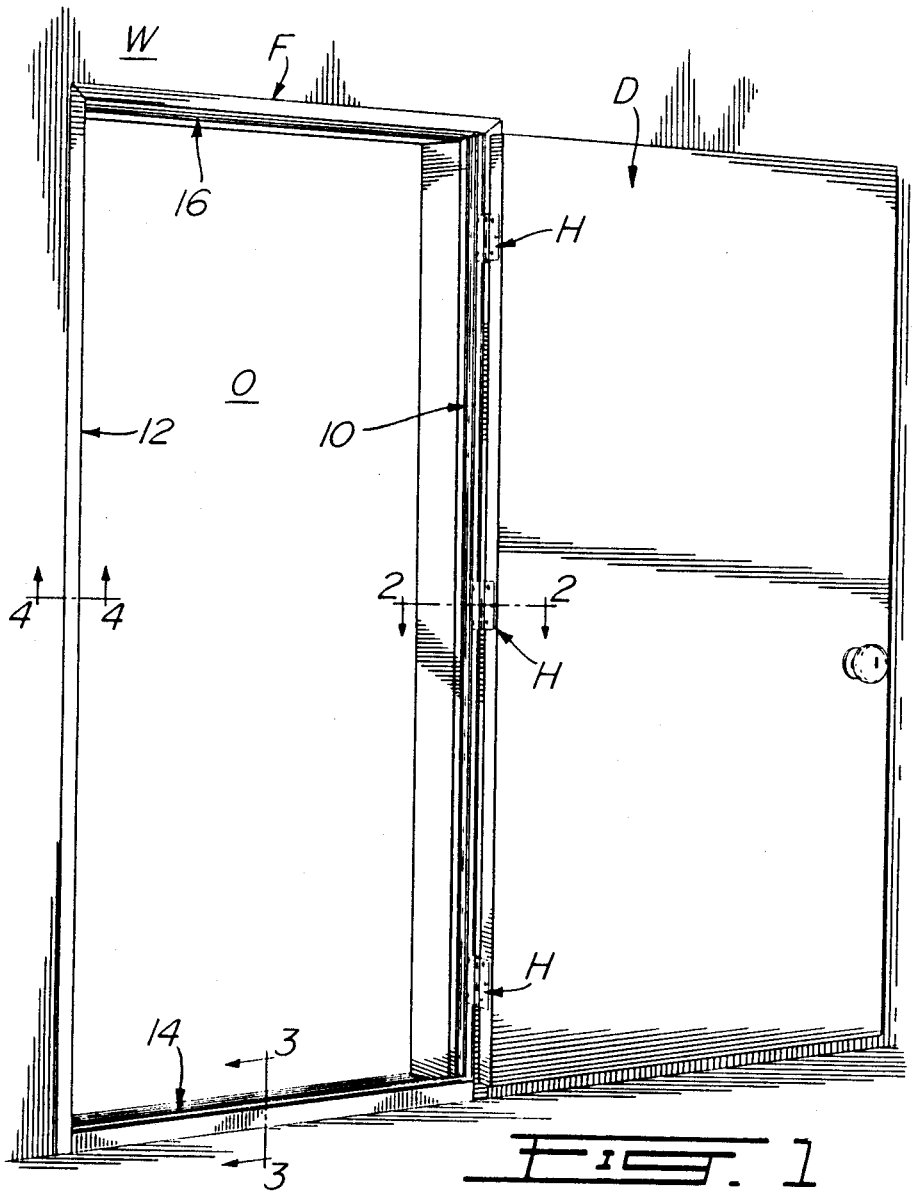
FIG. 1 is a perspective view showing a general door frame in accordance with the present invention.

FIG. 1 shows a wall W having a door opening O defined therein and bordered by a frame F in accordance with the present invention. The frame F comprises first and second jambs 10 and 12 respectively, a threshold 14 and a header 16. A door D which fits within the door frame F is mounted to the first jamb 10 by way of hinges H.

Figure 2:
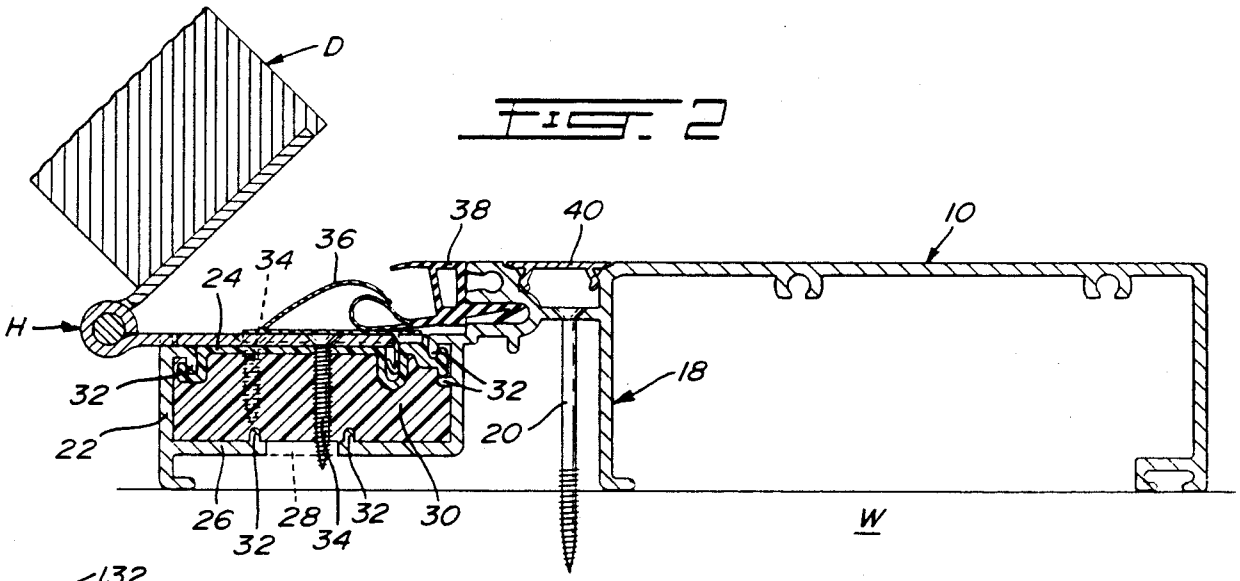
FIG. 2 is a cross-sectional view taken along lines 2—2 of FIG. 1 showing a jamb construction in accordance with the present invention to which a leaf hinge and a door are mounted.

The first jamb 10, which is illustrated in cross-section in FIG. 2, comprises an aluminum extruded member 18 which allows the first jamb 10 to be mounted to the wall W by way of screws 20. The extruded member 18 includes an elongated channel 22 which is open towards the door opening. An elongated vinyl member 24 which is relatively rigid is fitted to the free ends of the channel 22 to block off the open side thereof. The elongated channel 22 has on a back sidewall 26 thereof an elongated strip 28 which is sawed the length of the first jamb 10 and removed from the elongated channel 22 once an insulating material 30 injected in the elongated cavity defined by the elongated channel 22 and the elongated vinyl member 24 has hardened therein.

More particularly, the insulating material 30 is a rigid foam material such as Isolok TM which is injected in the aforementioned cavity. Once it has hardened, the elongated strip 28 can be sawed and removed from the elongated channel 22, the rigidity of the first jamb 10 being ensured by the hardened insulating material 30 which has set within the cavity and, more particularly, behind and between the different flanges 32 which project inwards from the elongated channel 22 and the different projections formed in the elongated vinyl member 24.

It is noted that Isolok TM is a polyurethane based rigid foam which has excellent thermal insulation properties. Furthermore, the chemical resistance of Isolok TM is very good and it grips well to the surfaces which it contacts, such as wood, concrete, ceramic and, of more interest, metal or aluminum. Isolok TM has a density of about 15 pounds/square foot.

The elongated member 24 is made of a vinyl material which is able to withstand the heat and pressure which it is subject to during the injection of the insulating material 30.

Once the insulating material 30 has set in the cavity defined by the elongated aluminum channel and vinyl member 22 and 24 and that the elongated strip 28 has been sawed off the former, the hinge H is mounted to the first jamb 10 by way of screws 34 which pass through the elongated vinyl member 24 and threadingly engage in the hardened insulating material 30 so as to be held in position thereby. Obviously, the insulating material 30 must be rigid enough in order to withstand the flexion forces exerted by the weight of the door D on the screws 34 by way of the hinge H. A rigid polyurethane foam such as Isolok TM is well suited to these mechanical constraints.

For sealing purposes, first and second seals 36 and 38 are fitted in elongated grooves defined respectively in the elongated vinyl member 24 and in the aluminum extruded member 18. An elongated aluminum plug 40 is press-fitted in position in the extruded member 18 to hide the screw 20.

The thermal barrier for the first jamb 10 is easily seen as the elongated aluminum channel 22 includes, once the aluminum strip 28 has been removed, two distinct parts separated by the vinyl member 24 and the rigid insulating material 30. The hinges H are mounted in order to contact at most only one of these two distinct conductive parts.

Figure 3:
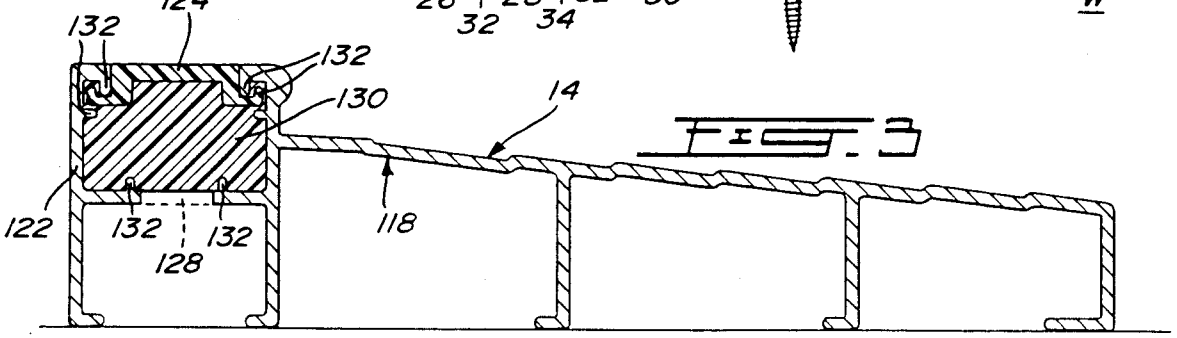
FIG. 3 is a cross-sectional view taken along lines 3—3 of FIG. 1 showing a threshold in accordance with the present invention.

The thermal barrier obtained in the construction of the threshold 14 is similar to that of the first jamb 10, as shown in FIG. 3. Parts of the threshold 14 which correspond to the above-described parts of the first jamb 10 (see FIG. 2) bear the same numbers as those of the first jamb 10 with one hundred having been added thereto to identify those parts which refer specifically to the threshold 14.

Indeed, the threshold 14 includes an aluminum extruded member 118 which includes an elongated channel 122 having its upper open end blocked off by an elongated vinyl member 124. Again, a hard insulating material 130, such as Isolok TM , is injected in the cavity defined by the elongated channel 122 and the elongated vinyl member 124. Once the insulating material 130 has set, an elongated aluminum strip 128 is sawed and removed from the elongated channel 122 thereby completing the thermal barrier. The insulating material 130 sets within sub-cavities defined by flanges 132 which extend inwards from the elongated channel 122. The stresses induced on the threshold 14 and thus on the insulating material 130 are substantially less than those acting on the first jamb 10 in view of the door D which exerts flexion forces on the latter.

Figure 4:
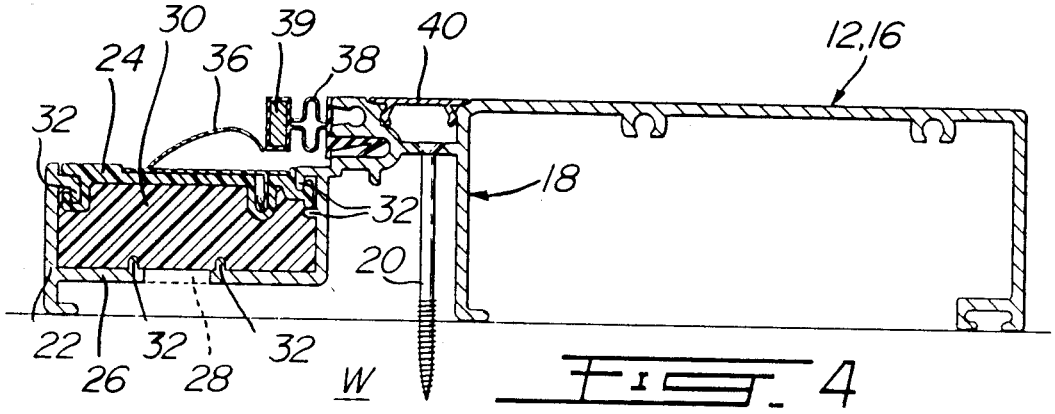
FIG. 4 is a cross-sectional view taken along lines 4—4 of FIG. 1 showing a jamb construction in accordance with the present invention which is adapted to receive the unhinged edge of the door.

FIG. 4 illustrates a cross-section of the second jamb 12. It is noted that the header 16 has a construction identical to that of the second jamb 12. Again, parts of the second jambs 12 which correspond to parts of the first jamb 10 of FIG. 2 bear the same numbers as those of the first jamb 10 with two hundred having been added thereto to identify those parts which refer specifically to the second jamb 12.

In both the second jamb 12 and the header 16, the frame construction is similar to that of the first jamb 10, as seen in FIG. 2, besides the hinge connection which is absent in the case of the second jamb 12 and the header 16. It is however noted that the second jamb 12 and the header 16 further include a magnetic seal 239 which complements the second seal 238 and which is not found in the construction of the first jamb 10.

It is easily seen from the above that the present invention provides for a thermal barrier in conventional jambs, thresholds and headers. Furthermore, conventional hinges such as leaf hinges can be used in the above-described jamb construction while maintaining the thermal barrier. The above constructions are all also simple and thus of low cost. The manufacture of the above frameworks is simple as well as the installation thereof.

I claim:

1. A frame construction for a wall opening comprising a rigid metallic member adapted to be secured along a length of a wall defining the wall opening, said metallic member including first and second elongated, spaced apart members each having first and second longitudinal free edges, said spaced apart members forming a channel configuration at least partly open-ended towards the wall opening between said first free edges, an insulating strip means being provided and extending between said first free edges of said spaced apart members for closing the open end of said channel configuration and for defining an elongated cavity therein, an insulating structural filler material being provided in said elongated cavity, whereby a thermal barrier is provided in said frame construction between said first and second spaced apart members which are separated by said insulating strip means and said filler material, said frame construction to receive a leaf hinge thereon while maintaining said thermal barrier, the leaf hinge being positioned for at least partly overlying said insulating strip means while being spaced from at least one of said first and second spaced apart members of said metallic member for maintaining said thermal barrier, the leaf hinge being fastened to said frame construction by way of screws passing through said insulating strip means and threadingly engaging said structural filler material.

2. A frame construction as defined in claim 1, wherein said first and second spaced apart members of said metallic member are generally L-shaped symmetric members each having first and second sections, said first sections of said first and second L-shaped members being substantially parallel to a plane of the wall opening whereas said second sections thereof extend towards each other at right angles from their respective first sections for defining bottom walls of said channel configuration which are transversely spaced from one another, said first and second free edges of said spaced apart members corresponding respectively to the free edges of said first and second sections of said L-shaped members.

3. A frame construction as defined in claim 2, wherein said metallic member is an aluminum extrusion.

4. A frame construction as defined in claim 1, wherein said structural filler material is an injected plastics material.

5. A frame construction as defined in claim 4, wherein said plastics material is a rigid polyurethane foam, such as Isolok TM.

6. A frame construction as defined in claim 1, wherein said insulating strip means is an elongated strip made of a substantially rigid and heat resistant plastic material, such as vinyl.

7. A frame construction as defined in claim 1, wherein the leaf hinge includes first and second sheet metal parts pivotally mounted to each other and mounted respectively to said frame construction and to one of a door and a window, the first sheet metal part of the leaf hinge partly overlying said insulating strip means and contacting a proximal one of said first edges and being spaced from a distal one of said first edges, said proximal first free edge being positioned closer to the pivot of the first and second sheet metal parts of the leaf hinge than said distal first free edge.

8. A frame construction as defined in claim 2, wherein said second sections of said first and second L-shaped members of said metallic member are spaced from the wall, whereby at least some of the screws transverse said structural filler material and extend between and spaced from said free edges of said second sections for maintaining said thermal barrier.

* * * * *

UNITED STATES PATENT AND TRADEMARK OFFICE

CERTIFICATE OF CORRECTION

PATENT NO. : 4,974,366

DATED : December 4, 1990

INVENTOR(S) : Salvatore TIZZONI

It is certified that error appears in the above-identified patent and that said Letters Patent is hereby corrected as shown below:

On the title page:

The priority data information is missing and should read as follows:

-- December 1, 1989 Canada..... 2,004,357-1 --.

In Figure 4, numerals "39" and "38" should read:

--239-- and --238--, respectively.

Signed and Sealed this

Eighth Day of September, 1992

*Attest:*

DOUGLAS B. COMER

*Attesting Officer*

*Acting Commissioner of Patents and Trademarks*